US006203166B1

(12) United States Patent
Byers

(10) Patent No.: US 6,203,166 B1
(45) Date of Patent: Mar. 20, 2001

(54) RECONFIGURABLE DECORATIVE STAR APPARATUS

(75) Inventor: Thomas L. Byers, Mustang, OK (US)

(73) Assignee: Gary Products Group, Inc., Lubbock, TX (US)

( * ) Notice: Subject to any disclaimer, the term of this patent is extended or adjusted under 35 U.S.C. 154(b) by 0 days.

(21) Appl. No.: 09/416,638

(22) Filed: Oct. 12, 1999

(51) Int. Cl.[7] ..... F21W 121/00

(52) U.S. Cl. ..... 362/121; 362/252; 362/250; 362/807

(58) Field of Search ..... 362/807, 252, 362/250, 121, 566

(56) References Cited

U.S. PATENT DOCUMENTS

| | | | | |
|---|---|---|---|---|
| 2,894,345 | * | 7/1959 | Bushnell | 362/121 |
| 3,184,366 | * | 5/1965 | Claude | 362/807 X |
| 3,704,367 | * | 11/1972 | Korb | 362/807 X |
| 4,523,260 | | 6/1985 | Duncan | 362/121 |
| 5,430,626 | * | 7/1995 | Leffel | 362/807 X |

FOREIGN PATENT DOCUMENTS

197809 * 9/1978 (DE) .

* cited by examiner

*Primary Examiner*—Laura K. Tso
(74) *Attorney, Agent, or Firm*—Locke Liddell & Sapp LLP

(57) ABSTRACT

A reconfigurable decorative apparatus which has a display position defining a star and a more compact collapsed, or storage position generally defines a rectangular shape. The apparatus is comprised of a plurality of elements pivotably connected to one another at the ends thereof. The members will pivot about connections points when the apparatus is moved between its display and storage positions. In the display position, the apparatus defines a star having a plurality of projections. To move the apparatus from its display to its storage position, connections between the ends of some of the members are removed to allow the members to pivot about the remainder of the connection points to a storage position. The apparatus may have lights attached thereto for display purposes and will move between its display and storage position with the lights attached.

31 Claims, 13 Drawing Sheets

RECONFIGURABLE DECORATIVE STAR APPARATUS

BACKGROUND OF THE INVENTION

This invention relates to a reconfigurable decorative apparatus and more specifically relates to a reconfigurable decorative star apparatus, which is movable between a display position, in which the apparatus defines a star shape and a collapsed, or storage position.

The use of decorative apparatus on homes, in yards, on commercial establishments and in other areas is well known. Oftentimes decorative apparatus are adorned with lights for display. The usage of lighted decorations is common, particularly during holiday seasons. One particular shape that is commonly used during the Christmas, Hanukkah and other holiday seasons is the star shape. Various star shapes are commonly used on the exterior of homes, on rooftops, in yards, atop and on the side of businesses and in or on other structures. Such decorative apparatus come in various star shapes and sizes, and in order to be plainly visible, star designs utilized on the exterior of homes and/or buildings or in yards or other open areas must be of a sufficient size to be easily seen from great distances. Storage of decorative stars can be difficult and inefficient in that a space large enough to store the entire star shape must be provided. For smaller stars, this may not be a problem but as the size of the star increases, storage can be more difficult and shipping costs increase. Thus, there is a need for an apparatus that has a star-shaped display position but that can be easily reconfigured to a more compact storage and/or shipping position and that can be easily alternated between the display and the collapsed positions.

SUMMARY OF THE INVENTION

The above needs along with other objects and advantages are met by the reconfigurable decorative apparatus of the present invention which is movable between a display position in which the apparatus defines a star having a plurality of projections and a collapsed or storage position. The apparatus has a display length and a display width in its display position, and a collapsed, or storage length and a collapsed, or storage width in its collapsed or storage position. The storage length is less than the display length and the storage width is less than the display width and is also less than the storage length.

The apparatus is constructed of a number of members having first and second ends. In the display position, the members are positioned such that the first end of each member is positioned adjacent the first end of an adjacent member and may be connected thereto. The second end of each member is likewise positioned adjacent and may be connected to the second end of another of the members. The connections at the first end may be referred as first end connections and the connections at the second end may be referred to as second end connections.

At least one of the first end and one of the second end connections is a releasable connection. At least the remainder of the first and second end connections are pivotable connections such that when the releasable first and second connections are released, the remainder of the members may pivot about the first and second end connections so that the apparatus can be moved between the display and collapsed positions. Each member may also intersect the adjacent member of an adjacent projection and may be pivotably connected thereto at the intersection point. Thus, the members will pivot about their first and second ends and about the intersection points when the apparatus is rotated between its display and collapsed positions.

The apparatus may have any number of projections but preferably in the display position defines a star having four, five or six projections. Decorative apparatus comprising stars having five projections are preferably constructed of ten substantially identical members, while stars having six projections are preferably constructed of twelve substantially identical members. The storage length of such stars is much less than the display length of the apparatus and is substantially identical to the length of the longest of the members utilized to construct the apparatus. In the case of the five projection decorative apparatus, the length of the apparatus in the storage position is equal to the length of one member which is one-half the display length. The collapsed length of the four and six projection decorative apparatus is preferably less than one-half the display length.

The present invention thus provides a reconfigurable apparatus that in its display position defines a star shape that can be easily collapsed by pivoting the members about connection points for a more compact shipping and/or storage position. Other objects, details and features of the present invention will become apparent from the following detailed description of the preferred embodiments along with the accompanying drawings.

BRIEF DESCRIPTION OF THE DRAWINGS

FIG. 8 shows the embodiment of FIG. 6 in a collapsed position.

FIG. 9 shows a member of construction of the apparatus of FIG. 6.

FIG. 16 is a section view taken from lines 16—16 of FIG. 1.

FIG. 16A shows a connection between the members used in the construction of the apparatus of the present invention.

FIG. 16B shows an alternative means of attaching lights to the apparatus of the present invention.

FIG. 18 shows the apparatus of FIG. 17 in a collapsed position.

FIG. 19 is a side view of a member of construction of the apparatus of FIG. 17.

FIG. 20 shows the front view of the member shown in FIG. 19.

DETAILED DESCRIPTION OF A PREFERRED EMBODIMENT

Figure 1:
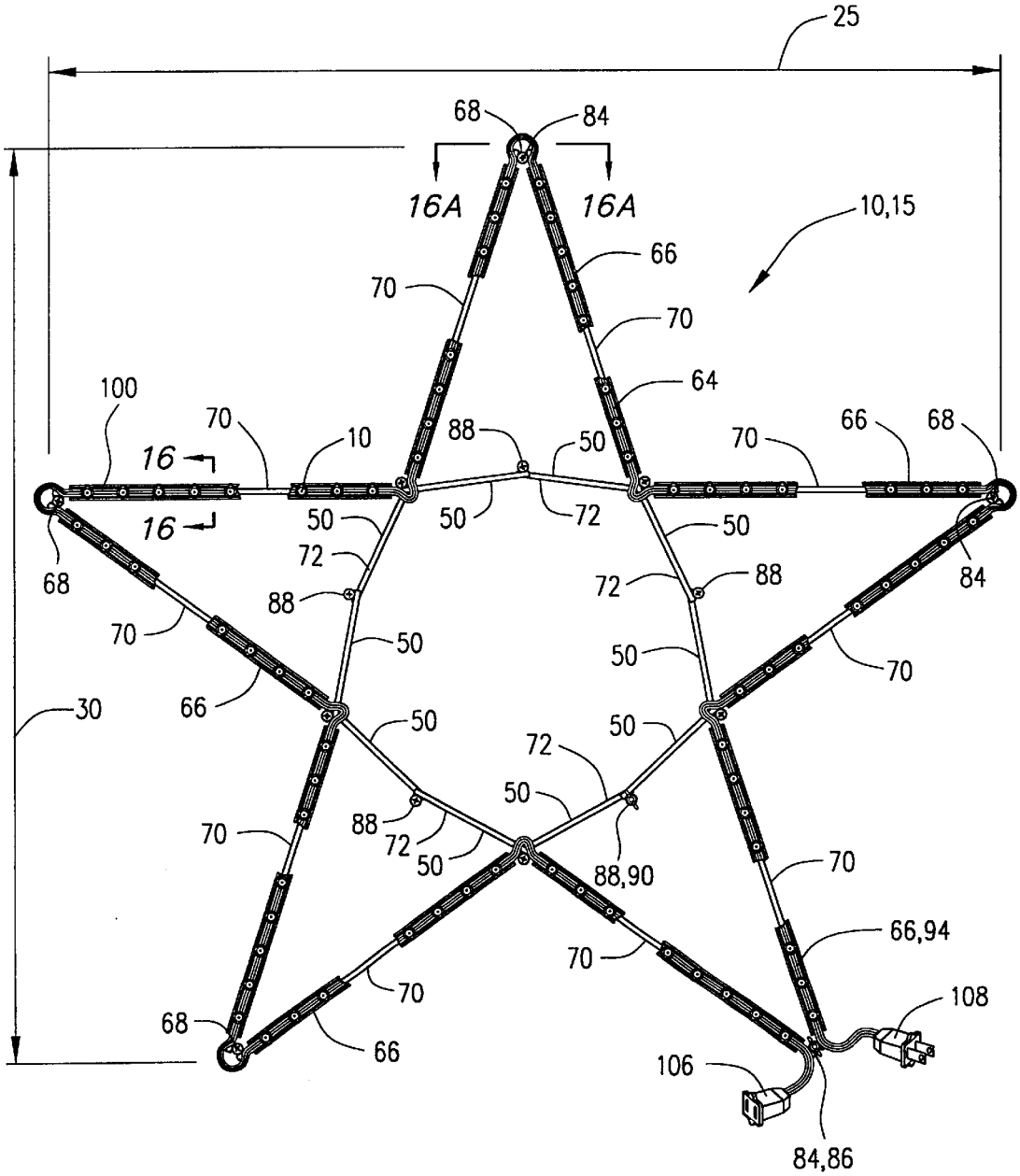
FIG. 1 is a front view of the reconfigurable star apparatus of the present invention in its display position, with a plurality of lights attached thereto.

Referring now to the drawings and more particularly to FIG. 1, a reconfigurable star apparatus 10 is shown in a display position 15, in which apparatus 10 defines a star. The apparatus is shown in a collapsed, or storage position 20 in FIG. 3. Apparatus 10 is selectively movable between its display and collapsed positions. In its display position 15, apparatus 10 has a length 25 and a width 30, which may be referred to as a display length 25 and a display width 30. Apparatus 10 also has a collapsed or storage length and width 35 and 40, respectively, in the storage position in which apparatus 10 defines a generally rectangular shape. As is apparent from the drawings, storage length 35 is considerably smaller in magnitude than display length 25 and storage width 40 is smaller than display width 30 and is also smaller than storage length 35. Thus, in its collapsed or storage position 20, apparatus 10 will fit and may be stored or shipped in a generally rectangular box having a length and a width only slightly larger than the length 35 and width 40.

Figure 4:
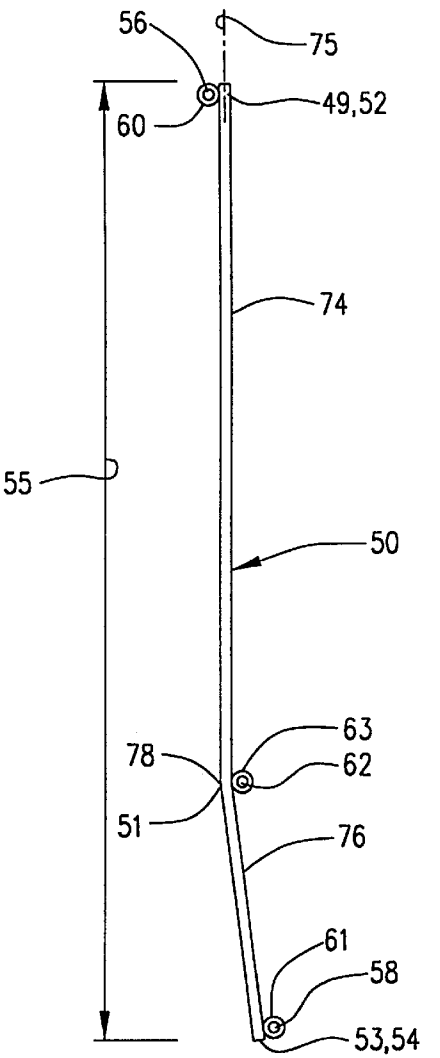
FIG. 4 is a detailed view of a single member of construction of the apparatus of FIG. 1.
Figure 5:
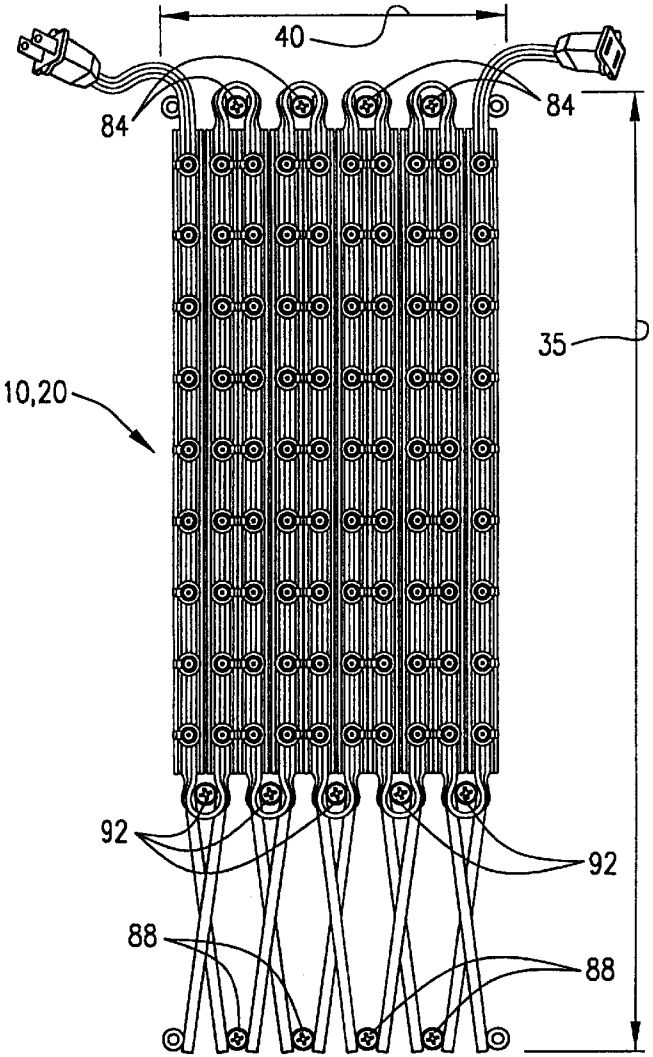
FIG. 5 shows an alternative embodiment of the basic component used in the construction of the apparatus of FIG. 1.
Figure 5:
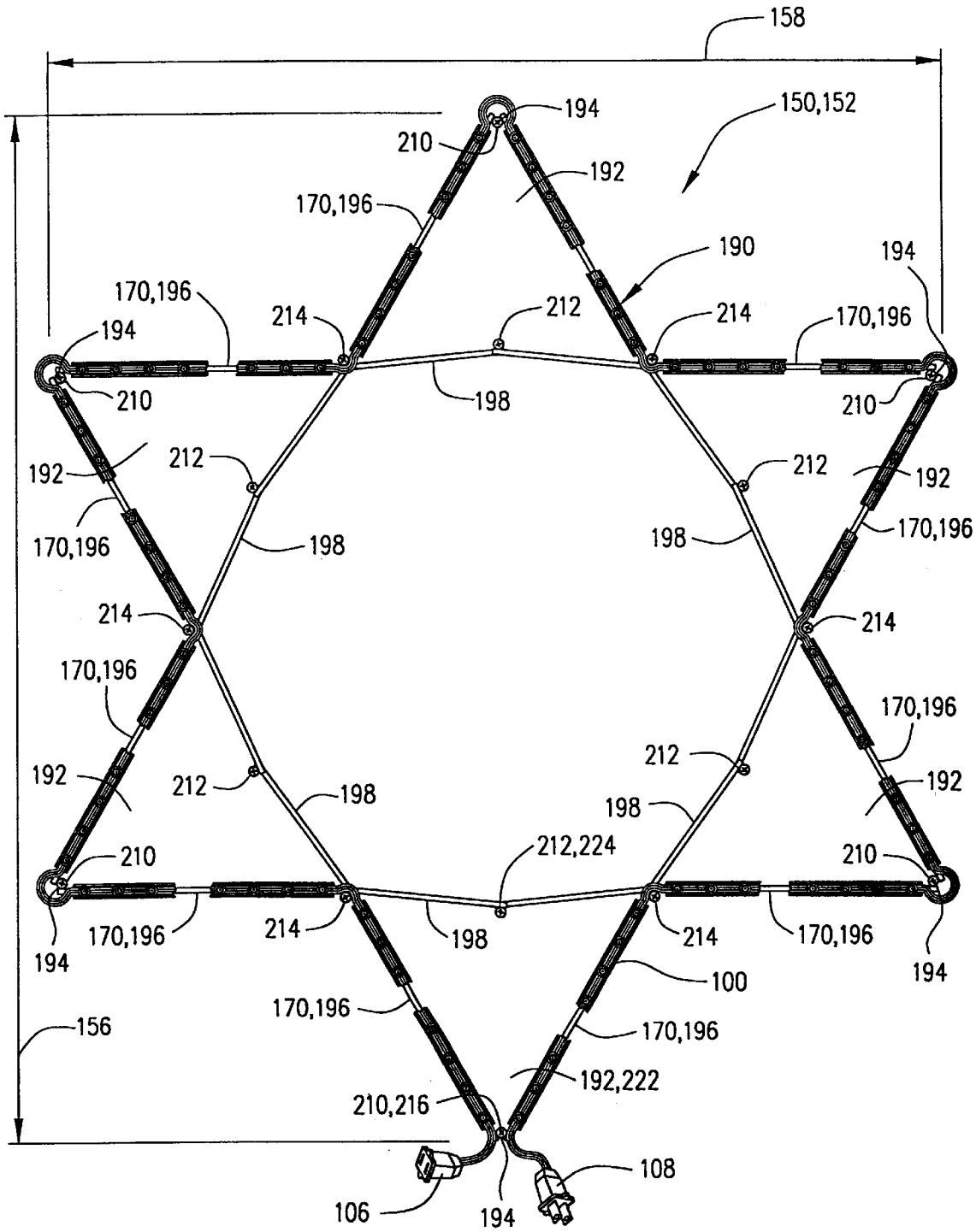
Figure 7:
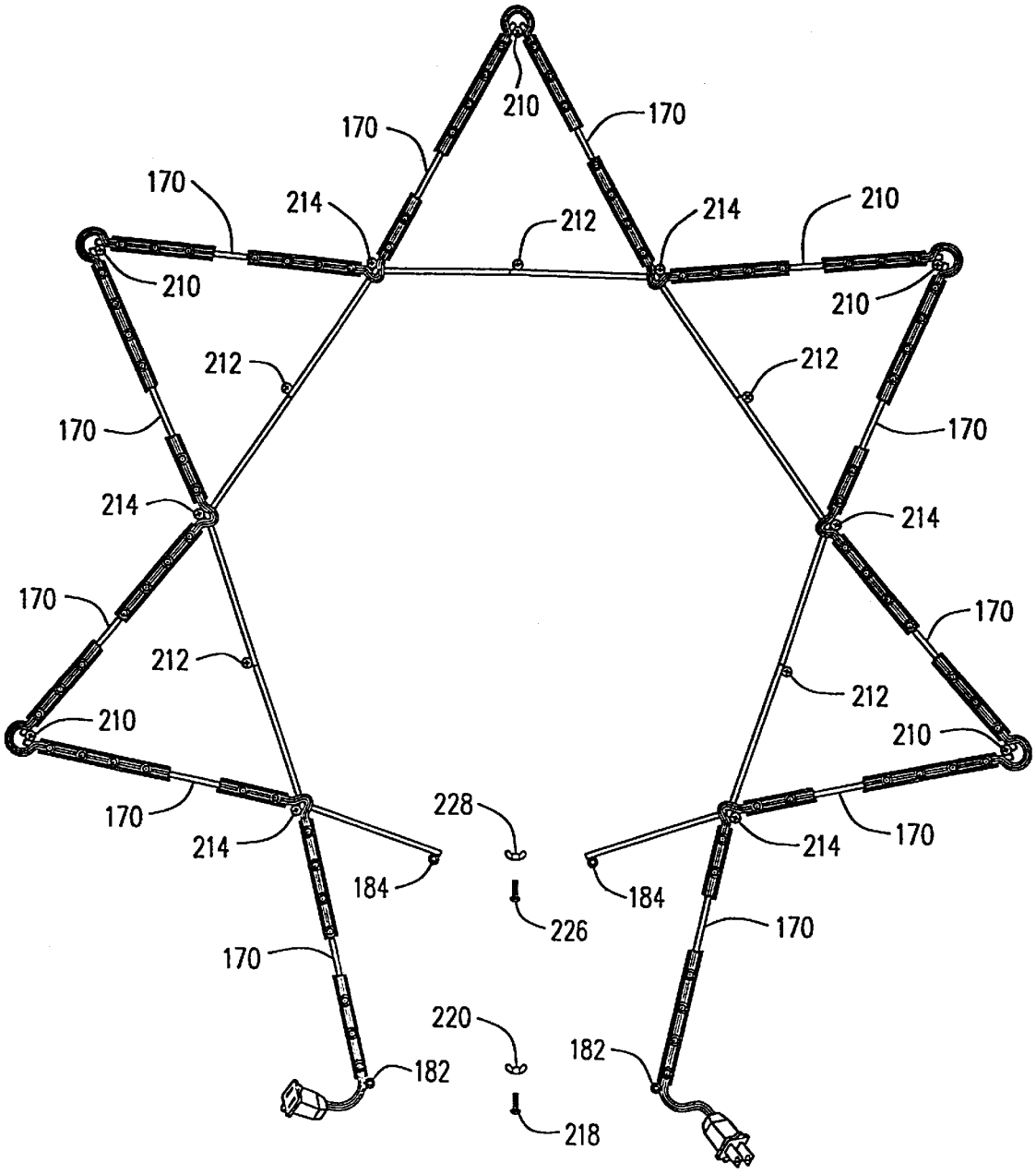
FIG. 7 shows the embodiment of FIG. 6 with connection points released and being moved to a collapsed position.
Figure 5:
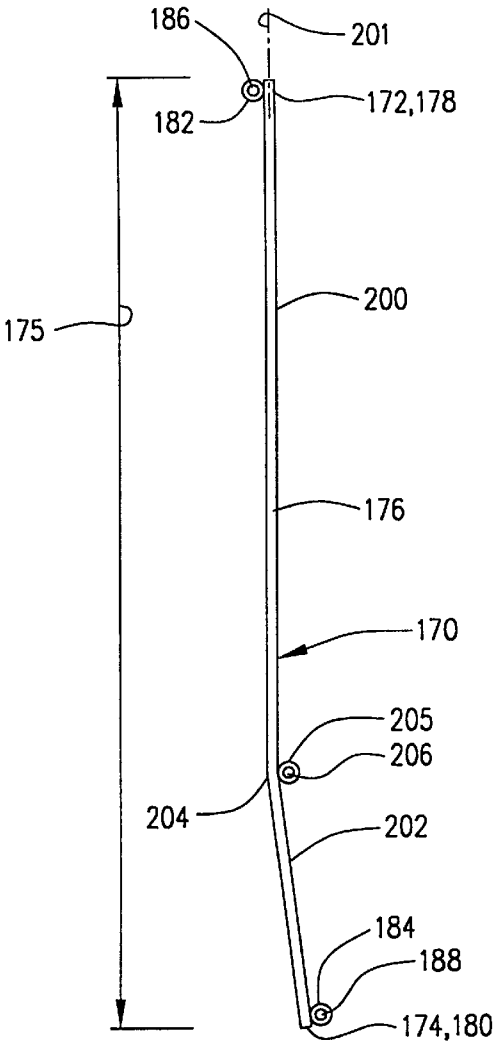

Apparatus 10 is comprised of a plurality of connectable members 50 shown in detail in FIG. 4. Members 50 may also be referred to as apparatus components 50. Member 50 has a first end 49, a second end 53 and a length 55. Member 50 comprises a generally tubular element 51 having first and second ends 52 and 54, respectively. Openings 56 and 58 are defined at the first and second ends 52 and 54 of tubular element 51, respectively. Openings 56 and 58 are adapted to receive connecting pins or fasteners for connecting members 50 to one another. In the embodiment shown in FIG. 4, openings 56 and 58 are defined by bushings 60 and 61 which may be welded or otherwise fixed to tubular element 51. An intermediate opening 62 is defined by an additional bushing 63 welded or otherwise affixed to tubular member 51 between ends 52 and 54. Opening 62 is defined on the same side of tubular member 51 as opening 58. Although member 50 is described as utilizing bushings attached to tubular member 51, the member may have openings defined at the ends thereof by forming the ends as shown in FIG. 5 which shows a basic component 50A comprising a tubular element 51A defining openings 56A and 58A at the ends thereof and having an opening 62A defined by bushing 63A between the ends thereof.

Members 50 are connectable members and thus may be connected to one another and arranged in display position 15 as shown in FIG. 1. In display position 15, the first end 49 of each member is positioned adjacent the first end 49 of another of said members, so that a screw or other fastener may be inserted through openings 56 in both members to connect the adjacent members 50 together. The second end 53 of each member is positioned adjacent the second end 53 of another of said members, so that a screw or other fastener may be inserted through openings 58 in both members to connect the members together. In display position 15, apparatus 10 defines a star 64 having a plurality of projections 66 which define star points 68. Apparatus 10 has five projections 66 of equal size and shape, and may be constructed of ten identical members 50. Each member 50 intersects an adjacent member of an adjacent projection 66 so that the openings 62 of the intersecting members are adjacent one another and may receive a screw or other fastener therethrough.

Each member 50 defines one side 70 of a projection 66 and defines a portion of the base 72 of an adjacent projection 66. Members 50 thus have a projection side portion, or first portion 74 and a projection base portion or second portion 76. First portion 74 has a longitudinal axis 75. Portion 76 is angled slightly from portion 74 which have a transition portion 78 therebetween. Opening 62 is preferably positioned adjacent or nearly adjacent to transition portion 78.

A typical connection at the first end of connectable members 50 is shown in FIG. 16A. As shown therein, a screw or other fastener 81 may be inserted in bushings 60 and a washer 80 may be positioned between bushings 60 to allow easier rotation of members 50 relative to one another. Fastener 81 may be held in place with a nut or other threaded element 82. Connections at first ends 52 are positioned generally at star points 68 and may be referred to as first end connections 84. At least one, and if desired, all of first end connections 82 may be releasable connections. In the embodiment shown in FIG. 1, a wing nut 85 is used in combination with a fastener 87 at a releasable first end connection 86 so that the connection can be easily released and apparatus 10 moved into its collapsed position 20 as explained in more detail hereinbelow.

The second end 54 of each of elements 50 may likewise connected to the second end of another of the members 50 to form the base 72 of a projection with fasteners 81 extending through openings 58 defined by bushings 61, along with washers 80 and nuts 82 as described with reference to the connection of first ends 52, and may be referred to as second end connections 88. At least one, and if desired more than one and even all of the second end connections may be a releasable connection 90 which in the embodiment of FIG. 1 utilizes a fastener 89 and a wing nut 91 so that the connection is easily releasable. Connections at the intersection between adjacent members 50 of adjacent projections may also utilize fasteners 81 extending through openings 62 defined by bushings 63, along with washers 80 and nuts 82, and may be referred to as an intermediate or base point connections 92.

Figure 2:
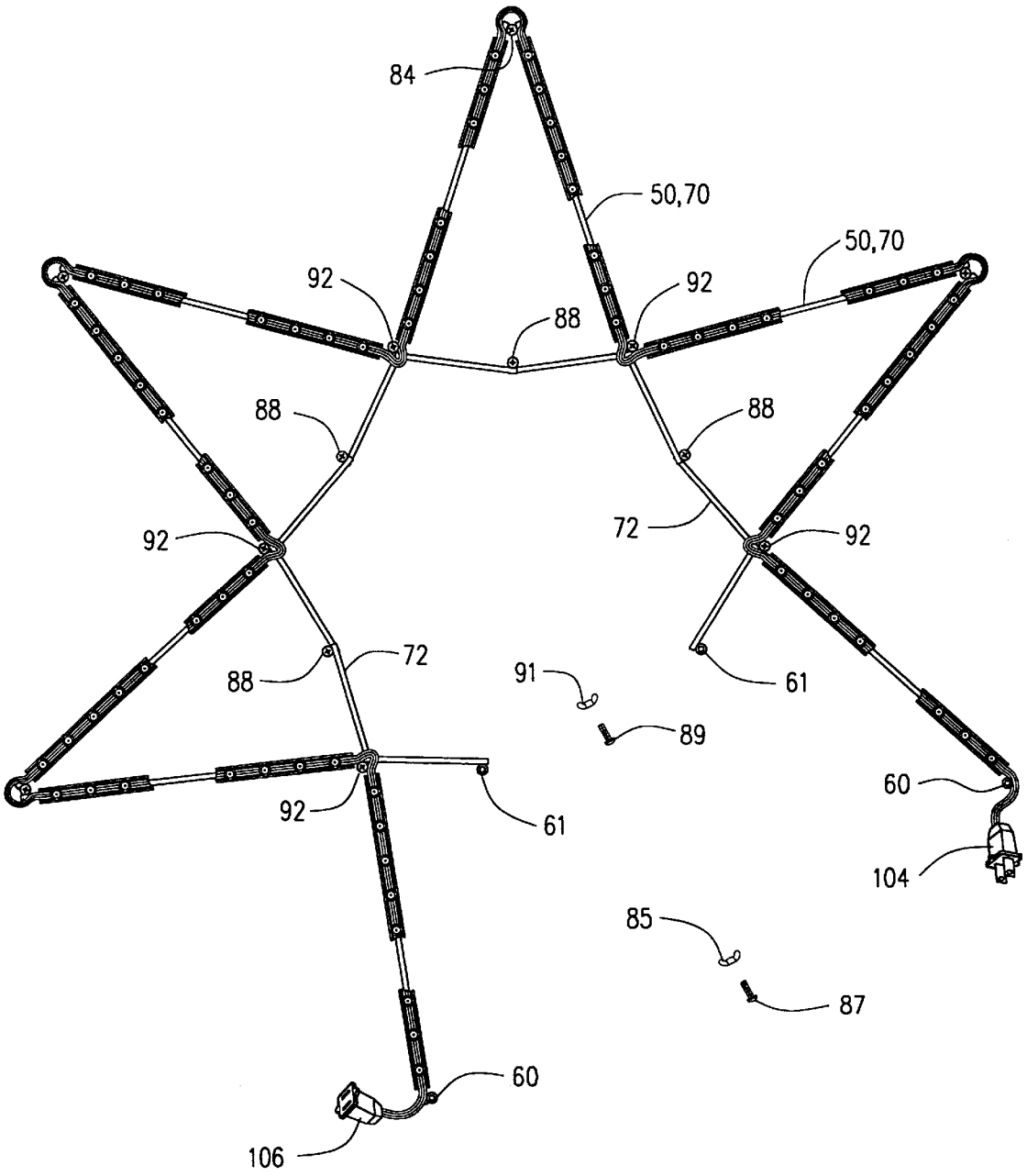
FIG. 2 shows the embodiment of FIG. 1 with the connection points released and being moved to a collapsed position.

The projection having releasable connections 86 and 90 may be referred to as a separable projection 94. Fastener 87 and wing nut 85 may be disengaged at releasable connection 86 and fastener 89 and wing nut 91 may be disengaged at releasable connection 90, so that the ends 49 of the member which defines sides 70 of separable projection 94 may be separated, along with the two ends 53 of the members 50 which form the base 72 of separable projection 94 as shown in FIG. 2.

Figure 3:
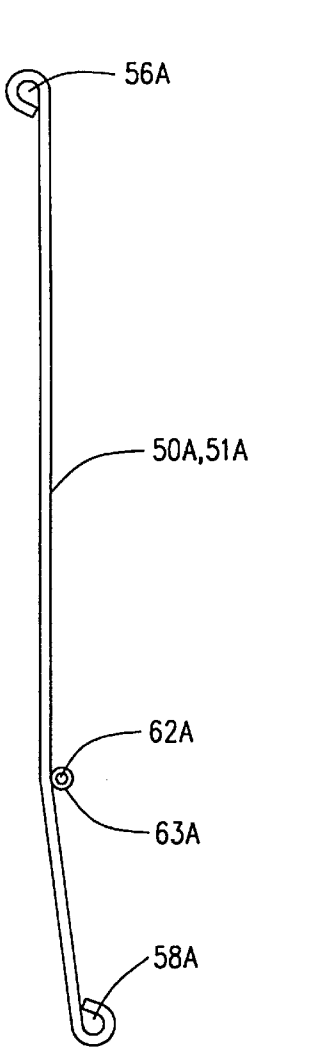
FIG. 3 shows the apparatus of FIG. 1 in its storage or collapsed position.

Members 50 are pivotably connected to one another at at least all of first end and second end connections 84 and 86 which do not comprise the releasable connection. Releasable connections 86 and 90 may also be pivotable connections. Each of the members 50 likewise are pivotably connected to an adjacent member 50 of an adjacent projection 60 at base point connection 92. Once connections 86 and 90 of separable projection 94 are released, the members 50 may pivot, or rotate about the remainder of connections 84, 88 and 92 and the members may be moved relative to one another about the connections to collapsed, or storage position 20 as shown in FIG. 3. Thus, even for apparatus in which the display length and width 25 and 30 are several feet, the apparatus 10 can be reconfigured and collapsed to its storage or collapsed position 20 for compact storage and/or shipping. As depicted in FIG. 3, the overall display length 35 is equivalent to the length 55 of an individual element which is one-half the length of the apparatus in its display position. The overall collapsed width, because of the accordion-like collapsible nature of apparatus 10 is less than length 35. Thus, the apparatus may be stored in a rectangular box having a length only slightly greater than the length 55 of an individual member 50 and having a width less than length 55.

Apparatus 10 may also include a plurality of lights 100 attached thereto. Lights 100 may generally comprise a light string of a type known in the art which includes bulbs 101 and bases 102 connected by interconnecting wires 104. Lights 100 may have adapter 106 at one end thereof for receiving a male plug-in and may have a male plug-in 108 at the other end thereof for connecting to an electric outlet, extension cord or other power source.

As shown in FIG. 16, apparatus 10 may include a track 109 for mounting lights 100 thereto. Track 109 may include a base 110 with side legs 111 extending upwardly therefrom. Flanges 112 extend inwardly from 110 so that light base 102 may be snapped into track 109 and held in place by flanges 112. An attachment clip 114 extends downwardly from base 110 and defines an arcuately shaped opening 116 having ends 118. The distance 120 between ends 118 is less than a diameter 122 of members 50 so that members 50 may be snapped into attachment clips 114. Utilizing such a configuration, a longitudinal axis 124 of bulbs 101 is perpendicular to the longitudinal axis 75 of first portion 74 of member 50. If desired, lights 101 may be mounted utilizing clips, ties or other attachment means so that bulbs 100 may be oriented from the member 50 at any desired angle. For example, lights 100 may be mounted using a clip 126 such that the longitudinal axis 124 thereof is parallel to longitudinal axis 75 of the first portion 74 of member 50 and thus parallel to sides 70 of projections 66. Such a configuration is shown in FIG. 16B. Clips 126 are adapted to be snapped or otherwise attached to bases 102 and members 50.

As depicted in FIGS. 1–3, the star apparatus may be moved between its display and collapsed positions 15 and 20 with lights 100 attached thereto and is thus ideal for seasonal use, since apparatus 10 can be moved to compact storage position 20 and stored over a period of time and can be easily moved from storage position 20 to display position 15 simply by pivoting the members relative to one another and positioning the members 50 to define the star. Members 50 of the separable projection 94 can then be connected and the star apparatus can be placed on a rooftop, on the side of a home or building, in a yard or in any desirable display area.

An additional embodiment of the reconfigurable decorative apparatus is shown in FIGS. 6–9. Shown therein is a reconfigurable star apparatus 150. Apparatus 150 is shown in its display position 152 in FIG. 6 and in its collapsed or storage position 154 as shown in FIG. 8. Apparatus 150 is selectively movable between its display and collapsed positions. In display position 152, the apparatus defines a star and has a length which may be referred to as a display length 156 and a width or display width 158. Apparatus 150 likewise has a storage or collapsed length 160 and a storage or collapsed width 162 in the storage position 154 in which apparatus 150 defines a generally rectangular shape. As is apparent from the drawings, length 160 is less than length 156 and width 162 is less than width 158 and is also smaller in magnitude than length 160. Thus, apparatus 150 can be shipped and/or stored in a box having dimensions only slightly larger than length 160 and width 162.

Apparatus 150 is comprised of a plurality of members or apparatus components 170 having first and second ends 172 and 174, respectively and a length 175. Members 170 may comprise a generally tubular element 176 having first and second ends 178 and 180, respectively. Member 170 may have bushings 182 and 184 positioned at the first and second ends 172 and 174 thereof. Bushings 182 and 184 may be affixed to tubular element 176 by welding or other means. Bushings 182 and 184 define openings 186 and 188, respectively, at the first and second ends of member 170 and are adapted to receive screws, connecting pins or other connecting means. Alternatively, openings 186 and 188 may be defined by forming the ends 178 and 180 of element 176.

Figure 6:
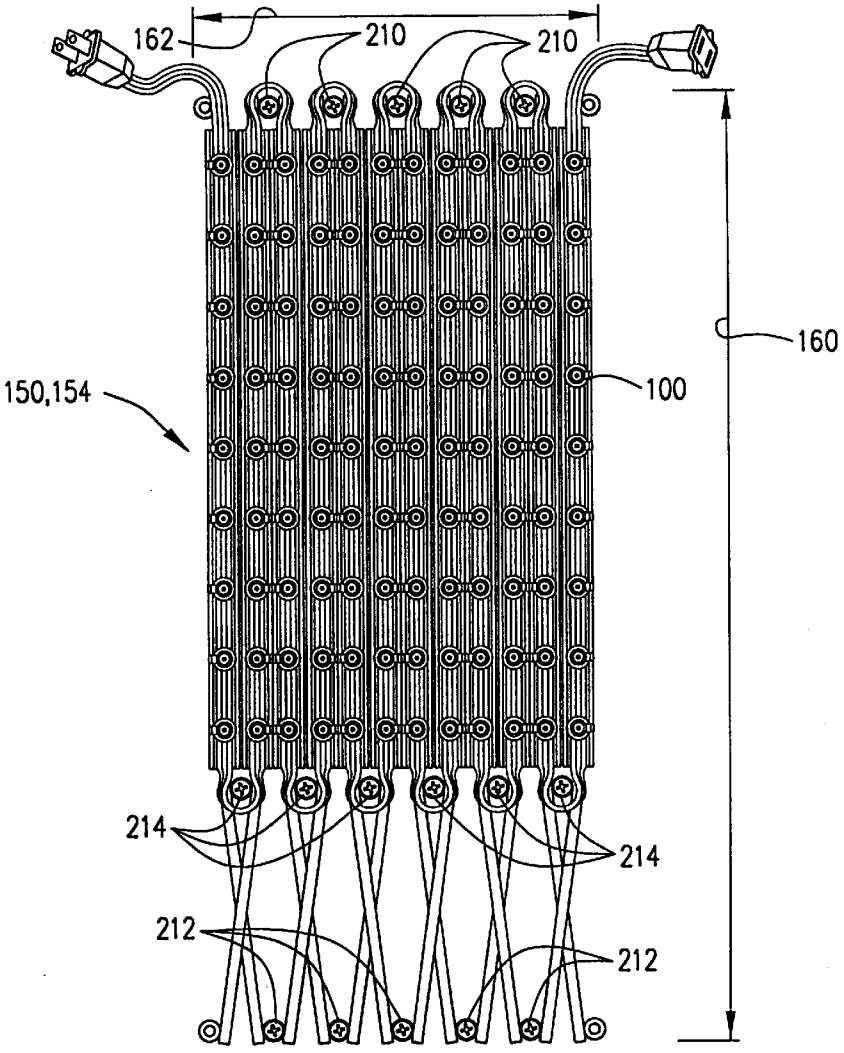
FIG. 6 is an alternative embodiment of a reconfigurable star apparatus in its display position and having a plurality of lights attached thereto.

As shown in FIG. 6, members 170 may be arranged such that in display position 152 apparatus 150 defines a star 190 having a plurality of projections 192 defining plurality of star points 194. The embodiment of FIG. 6 has six projections 192 of substantially identical size and shape, and may be constructed with twelve substantially identical members 170.

Each member 170 defines a side 196 of a projection 192 and defines a portion of the base 198 of an adjacent one of projections 192. Thus, each member 170 has a projection side or first portion 200 and a projection base or second portion 202. First portion 200 has a longitudinal axis 201. Second portion 202 is angled slightly from first portion 200 and a transition portion 204 is located therebetween. A bushing 205 is affixed to tubular element 176 adjacent, or nearly adjacent transition 204 and defines an opening 206. In the display position 152, the first end 172 of each member 170 is positioned adjacent the first end 172 of an adjacent one of members 170 to define the sides 196 of a projection 192. The second end 174 of each member may be positioned adjacent the second end 174 of another of said members to define the base 198 of a projection 192 and intermediate openings 206 of intersecting members 170 are positioned adjacent each other.

The members may be connected at the first ends 172 through openings 186 defined by bushings 182 at the second ends 174 through openings 188 defined by bushings 184, and through intermediate openings 206 defined by bushings 205, with the fastener 81, washer 80, and nut 82 arrangement previously described with respect to apparatus 10. The connection at the first ends of members 170 may be referred to as first end connection 210. Connections at second ends 174 may be referred to as second end connections 212, and connections at the intersection of adjacent members of adjacent projections through bushings 205 may be referred to as base point or intermediate connections 214.

At least one of first end connections 210 comprises a releasable connection 216 which may comprise a screw and wing nut 218 and 220, respectively. The projection including the releasable connection may be referred to as a separable projection 222, in that the ends of the members 170 that define the projection are separable. At least one of the second end connections is also a releasable connection 224, and may comprise a screw 226 and a wing nut 228. The adjacent members 170 which form the sides 196 of separable projection 222 can be separated after the connections 216 and 224 are released. If desired one or all of the first and second end connections can utilize commonly known elements such as screws and nuts which will allow the first and second end connections to be releasable, so that any or all of the projections may comprise a separable projection. Once releasable connections 216 and 224 have been released, the members 170 that have been separated can be rotated and the members 170 will pivot about the remainder of the first and second end connections 210 and 212 and intermediate connections 214. Thus, at least all of the first end, second end and base point connections except for releasable connections 216 and 224 comprise pivotable connections and the apparatus 150 can be moved easily between its display and collapsed positions 152 and 154, respectively. Connections 216 and 224 may also comprise pivotable connections.

Length 160 of apparatus 150 in its storage position 154 is identical to length 175 of one element 170 and is thus less than one-half display length 156. Collapsed width 172 is less than length 160 and thus the apparatus can be stored in a rectangular box. Because the apparatus is reconfigurable in this manner, it may have a length and width of several feet in the display position and still be capable of being readily stored and shipped in a compact, generally rectangular box.

As explained with reference to FIG. 1 and apparatus 10, apparatus 150 may include lights 100 attached to members 170 with track 109 such that longitudinal axis 124 of the bulbs is perpendicular to longitudinal axis 201 of the side of projections 192. If desired, lights 100 can be attached to the members with clips 126 so that longitudinal axis 124 of bulbs 101 is parallel to the longitudinal axis of the sides 201 of projections 192 or may be attached in any way known in the art to have any desired orientation.

Figure 10:
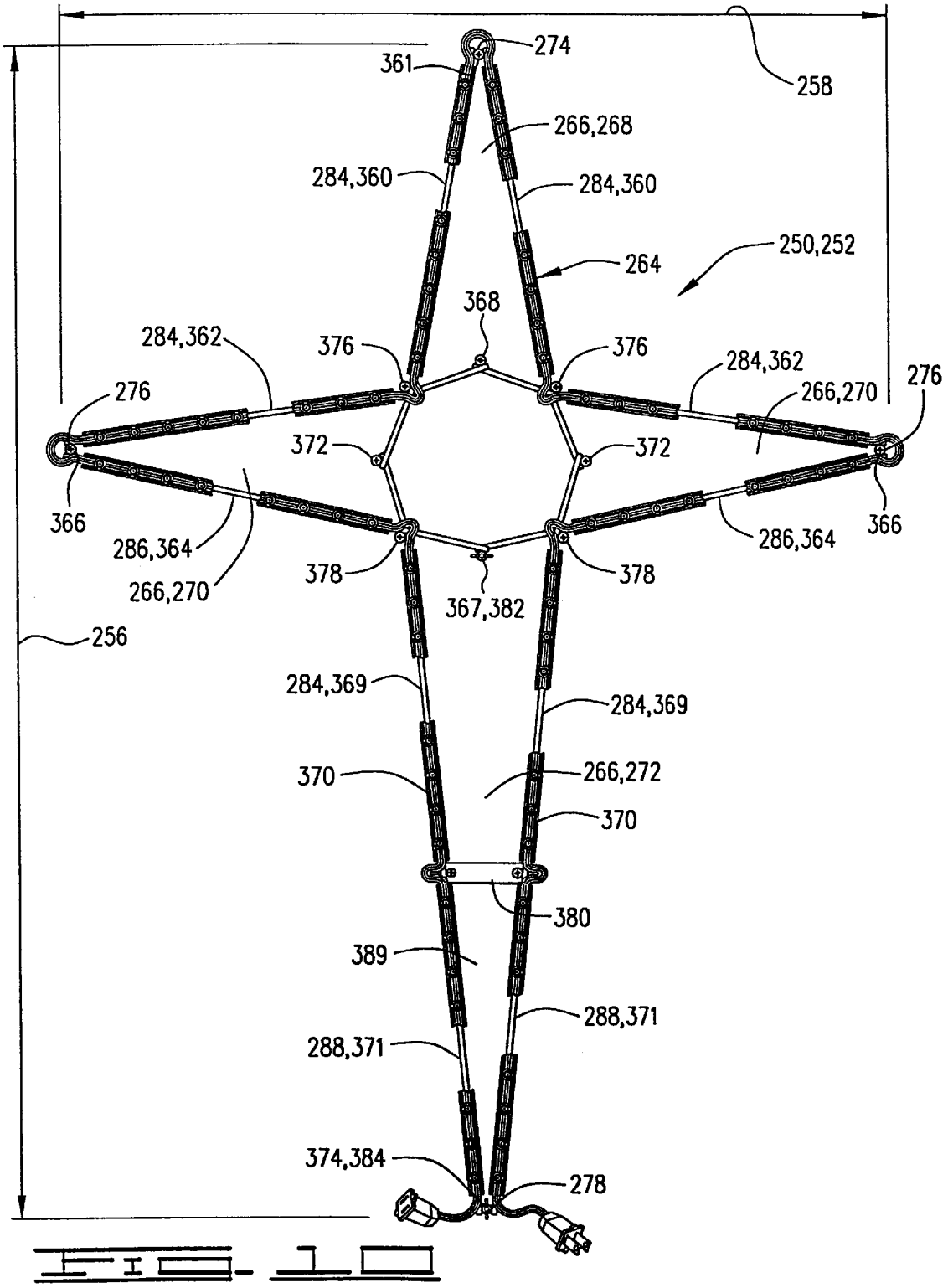
FIG. 10 shows an additional embodiment of the reconfigurable star apparatus of the present invention with lights attached thereto.
Figure 11:
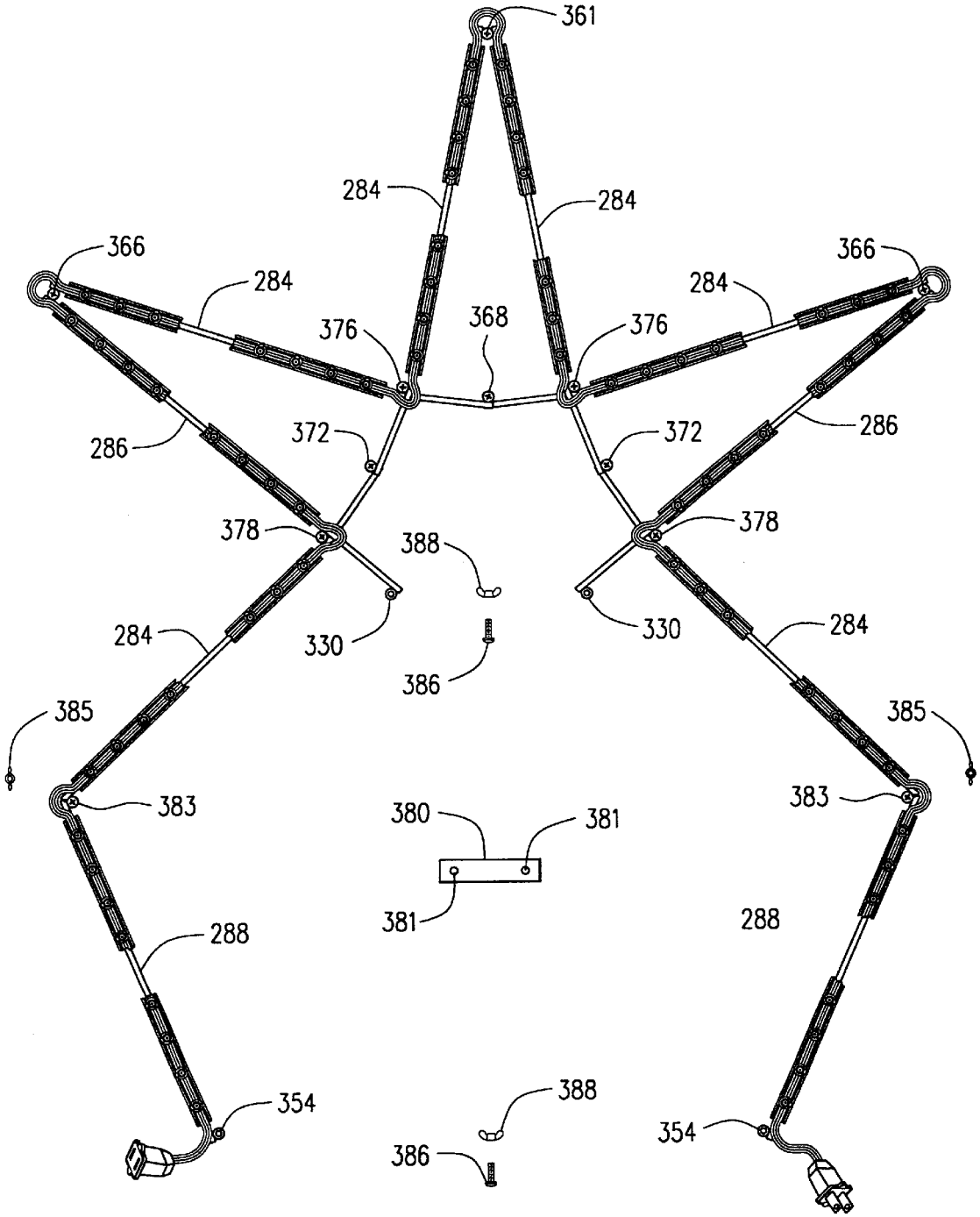
FIG. 11 shows the embodiment of FIG. 10 with connection points released and being moved to its collapsed position.
Figures 12, 14, 15:
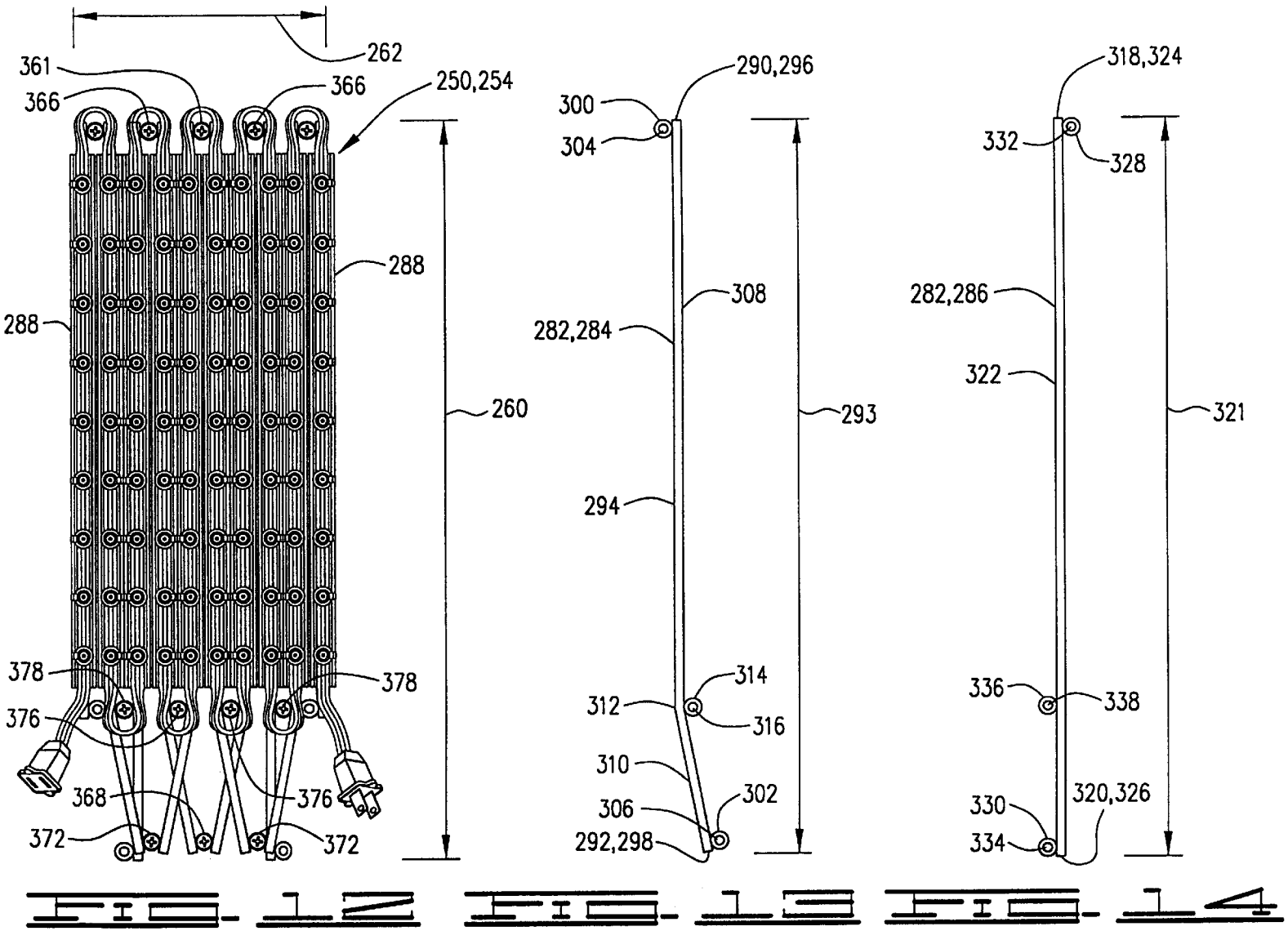
FIG. 12 shows the apparatus of FIG. 10 in its collapsed position.
FIGS. 13, 14 and 15 show views of the members utilized in the construction of the apparatus of FIG. 10.
Figure 1:
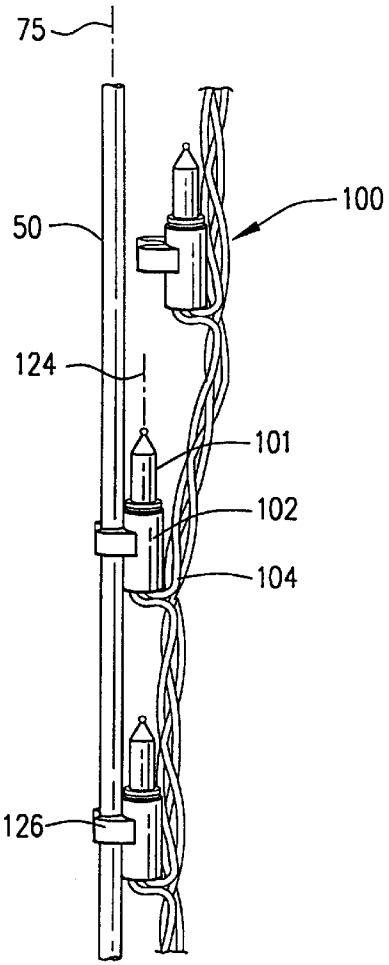
Figure 2:
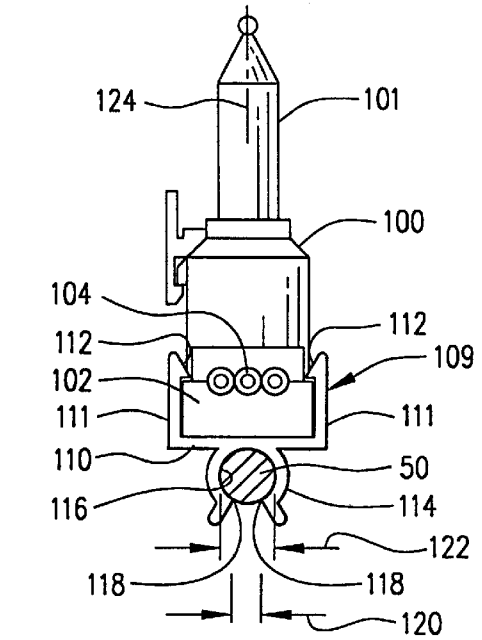
Figure 3:
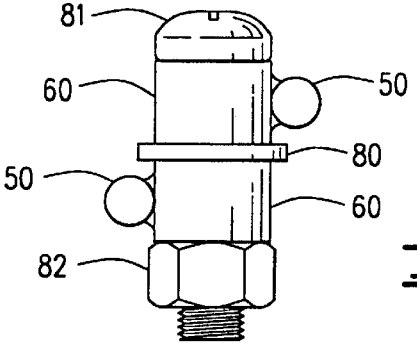
Figure 4:
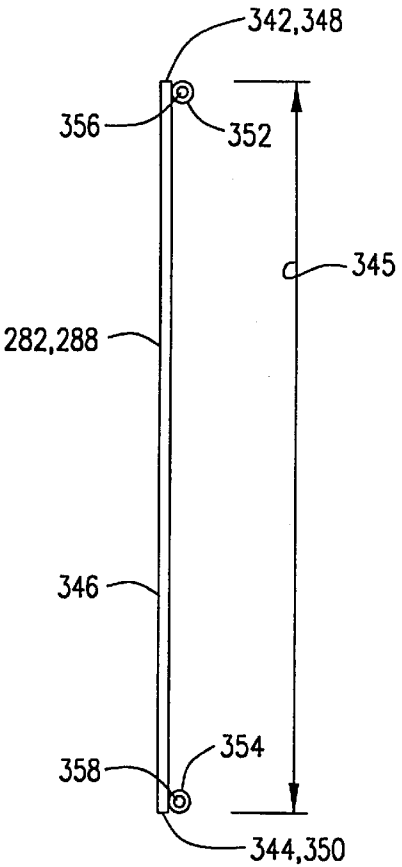

An additional embodiment of a reconfigurable star apparatus is shown in FIGS. 10–12 and is generally designated by the numeral 250. FIG. 10 shows the apparatus 250 in a display position 252 in which the apparatus defines a star shape. FIG. 11 shows the apparatus in its collapsed or storage position 254. In display position 252, apparatus 250 has a display length 256 and a display width 258. Apparatus 250 likewise has a storage length 260 and a storage width 262. Display apparatus 250 is selectively movable between its display position in which it defines star 264 to its collapsed or storage position in which apparatus 250 defines a generally rectangular shape having length 260 and width 262 such that the apparatus in its collapsed position 254 may be stored or shipped in a box having dimensions only slightly larger than the length and width of the apparatus 250 in its collapsed position. As is apparent from the drawings, length 260 is considerably less than length 256 and width 262 is less than length 260 and less than width 258 of apparatus 250 in its display position.

Figures 12, 13, 14:
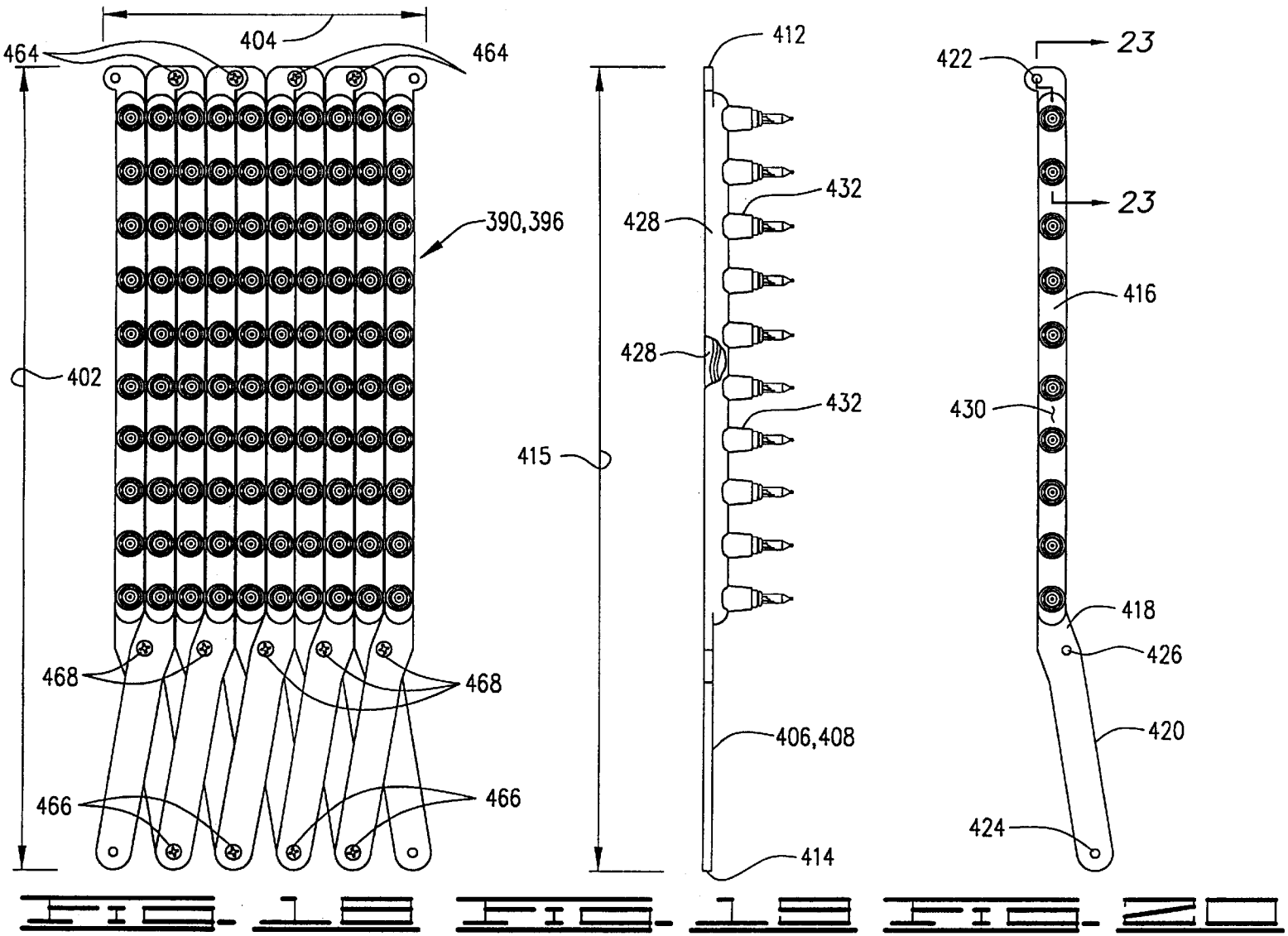
Figure 21:
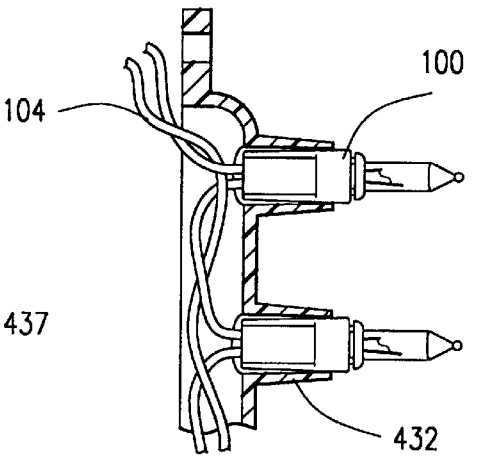
FIG. 21 is a side view of a member utilized in the construction of the apparatus of FIG. 17.
Figure 22:
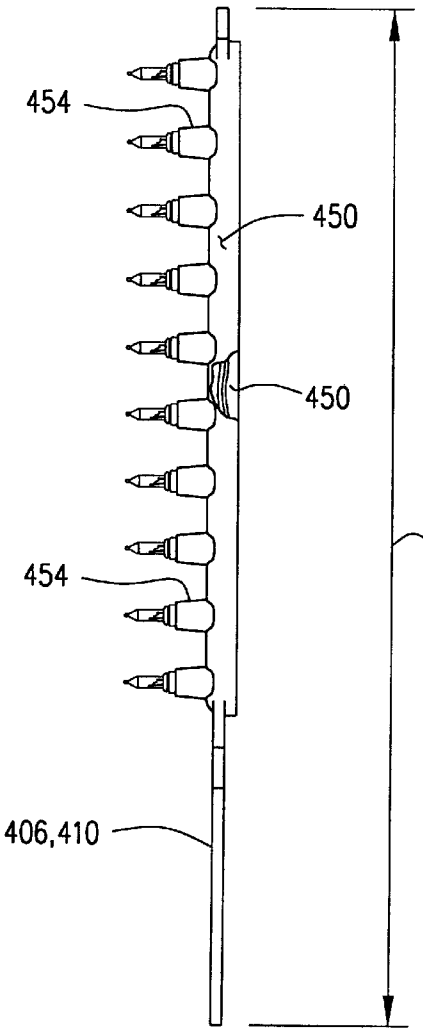
FIG. 22 shows a front view of the member shown in FIG. 21.
Figure 23:
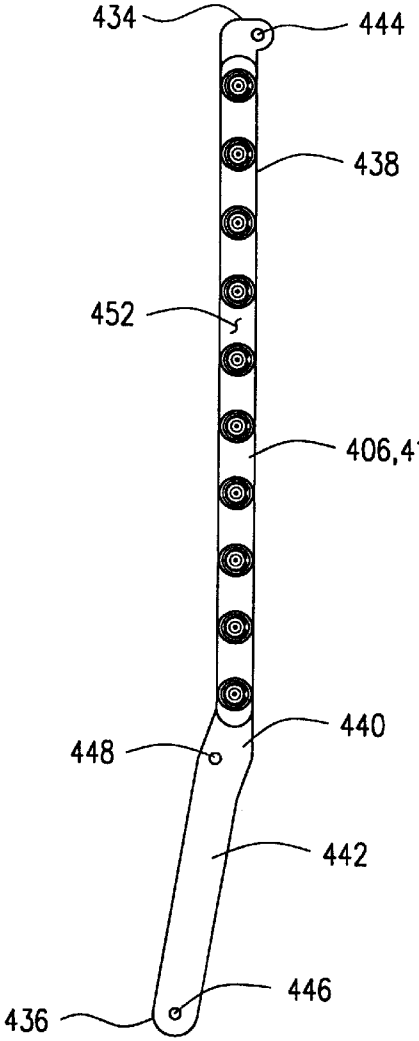
FIG. 23 is a section view taken from lines 23-23 of FIG. 20.

Referring now back to FIG. 10, star 250 has four projections 266 comprising an upper projection 268, side projections 270 and a lower projection 272. Projections 266 define an upper star point 274, side star points 276 and a lower star point 278. The projections are defined by a plurality of connectable members 282. Members 282 are pivotably connectable to one another such that the reconfigurable apparatus 250 may be easily moved between its display position 252 and its storage position 254. The details of members 282 may be seen more clearly in FIGS. 13–15 and may comprise members 284, members 286 and members 288. The embodiment shown in FIG. 10 includes six members 284, two members 286 and two members 288. Member 284 has a first end 290 and a second end 292 and has a length 293. Member 284 is comprised of a generally tubular element 294 having first end 296 and second end 298. Bushings 300 and 302 may be affixed to the first and second ends 296 and 298 of tubular member 294 and define openings 304 and 306, respectively. Bushings 300 and 302 are positioned on opposite sides of tubular member 294. Member 284 has a projection side or first portion 308 and a projection base or second portion 310 angled therefrom. Member 284 includes a transition portion 312 positioned between portions 308 and 310. A bushing 314 defining an opening 316 is affixed to tubular member 294 adjacent transition portion 312. Bushings 300, 302 and 314 may be referred to as first end, second end and intermediate bushings and the bushings are adapted to receive screws, connecting pins or other connecting means known in the art.

Member 286 has a first end 318 and a second end 320 and a length 321, which may be substantially identical to length 293. Member 286 comprises a generally tubular element 322 having first end 324 and second end 326. Bushings 328 and 330 which may be referred to as first and second end bushings 328 and 320 are affixed to tubular member 322 at the first and second ends thereof and define openings 332 and 334, respectively. An intermediate bushing 336 is positioned between first and second ends 318 and 320 and defines an opening 338. Openings 332, 334 and 338 are adapted to receive connecting screws, pins or other connecting means.

Member 288 has a first end 342 and a second end 344 and a length 345. Member 288 comprises a generally tubular element 346 having first end 348 and second end 350. Bushings 352 and 354 are affixed to tubular element 346 at the first and second ends thereof and thus comprise first and second end bushings. Bushings 352 and 354 define openings 356 and 358, respectively. Openings 356 and 358 are adapted to receive connecting screws, connecting pins or other connecting means.

Referring now back to FIG. 10, upper projection 268 has sides 360 defined by elements 284 which are connected at the first ends 290 thereof at a first end connection 361. The side projections 270 have upper sides 362 defined by elements 284 and lower sides 364 defined by elements 286. Elements 284 and 286 are connected together at the first ends 290 and 318, respectively, thereof to define first end connections 366. Members 284 which define the upper sides 362 of side projections 270 are connected together at the second ends 292 thereof at second end connection 368. Members 286 are connected to one another at the second ends thereof at a second end connection 367.

As is apparent from the drawings, lower projection 272 is longer than the side and upper projections such that the distance from the base of the lower projection to the point thereof is greater than the distance from the base of the side and upper projections to the points thereof. Because lower projection 272 is longer than the side and upper projections, lower projection 272 has sides 370, each of which is defined by two members connected to one another at the ends thereof. Thus, members 284 which define upper projection 268 are connected at second ends 292 thereof at a second end connection 372 to the second ends 292 of additional elements 284 which extend downwardly therefrom and define an upper portion 369 of sides 370 of lower projection 272. Lower portions 371 of sides 370 are defined by members 288. The first ends 290 of members 284 which define portions 371 are connected to second ends 344 of members 288 which extend downwardly therefrom. Members 288 are connected to one another at the first ends 342 thereof to define a first end connection 374.

Sides 360 of upper projection 268 are connected to upper sides 362 of side projections 270 at intermediate connections 376 through bushings 314 on members 284. Lower sides 364 of side projections 270 are connected to sides 370 of lower projection 272 at intermediate connections 378 through bushings 314 and 336 on members 284 and 286, respectively. The first end, second end and intermediate connections may be like that described with reference to prior embodiments and thus may include a fastener 81 or other threaded fastener extending through bushings in the members and may have a nut 82 attached thereto. A washer 80 may be disposed between bushings to allow easier pivotal movement.

Apparatus 250 may also include a strap 380. Strap 380 defines holes 381 therethrough, and is preferably a rigid strap which in display position 252, is connected to the first ends of the members 284 and the second end of the members 288 which defines sides 370 of lower projection 272. The connection to strap 380 may simply comprise a threaded fastener 381 extending through holes 381 and through bushings 300 in members 284 and 354 in members 288. A wing nut 385 or other nut may be used on the threaded end of the threaded fastener so that strap 380 may be easily removed.

At least one first end connection and one second end connection of apparatus 250 is a releasable connection. In the embodiment shown in FIG. 10, connections 367 and 374 preferably comprise releasable connections 382 and 384, respectively, and thus may simply include a threaded fastener 386 extending through the connecting bushings and a wing nut 388. Lower projection 272 may therefore be referred to as a separable projection 389. At least all of the first end, second end and intermediate connections, except for connections 382 and 384, allow rotation or pivotal movement so that the members are pivotably connected to one another and releasable connections 382 and 384 may also be pivotable connections.

To move the apparatus from its display to its collapsed position, strap 380 is removed by simply unthreading the wing nut. The wing nuts can be rethreaded onto fastener 383 after the strap is removed, which will allow the members 284 and 288 that define lower projection 370 to pivot relative to one another. If desired, the lower projection can be defined by two rigid members, one defining each side of the projection. The result will be a longer storage length. Once releasable connections 382 and 384 are released, legs 370 are rotated and all of members 282 are pivoted relative to one another as shown in FIG. 11. The members will continue to pivot about the first end, second end and intermediate connections until apparatus 250 is placed in its collapsed position 254 as shown in FIG. 12. Apparatus 250 is therefore easily alternated between its display and collapsed positions simply by pivoting the members about their connections.

Storage length 260 is equal to the length of the longest of the members 282 and thus is equal to the length of members 284 and 286, which is less than one-half display length 256. Width 262 is less than length 260. Storage apparatus 250 may have lights 100 attached thereto with track 109 or clips 126 in the manner previously described with respect to prior embodiments, or may have lights attached thereto in any desired orientation. Apparatus 250 may be alternated between positions 252 and 254 with lights 100 attached thereto.

Figure 17:
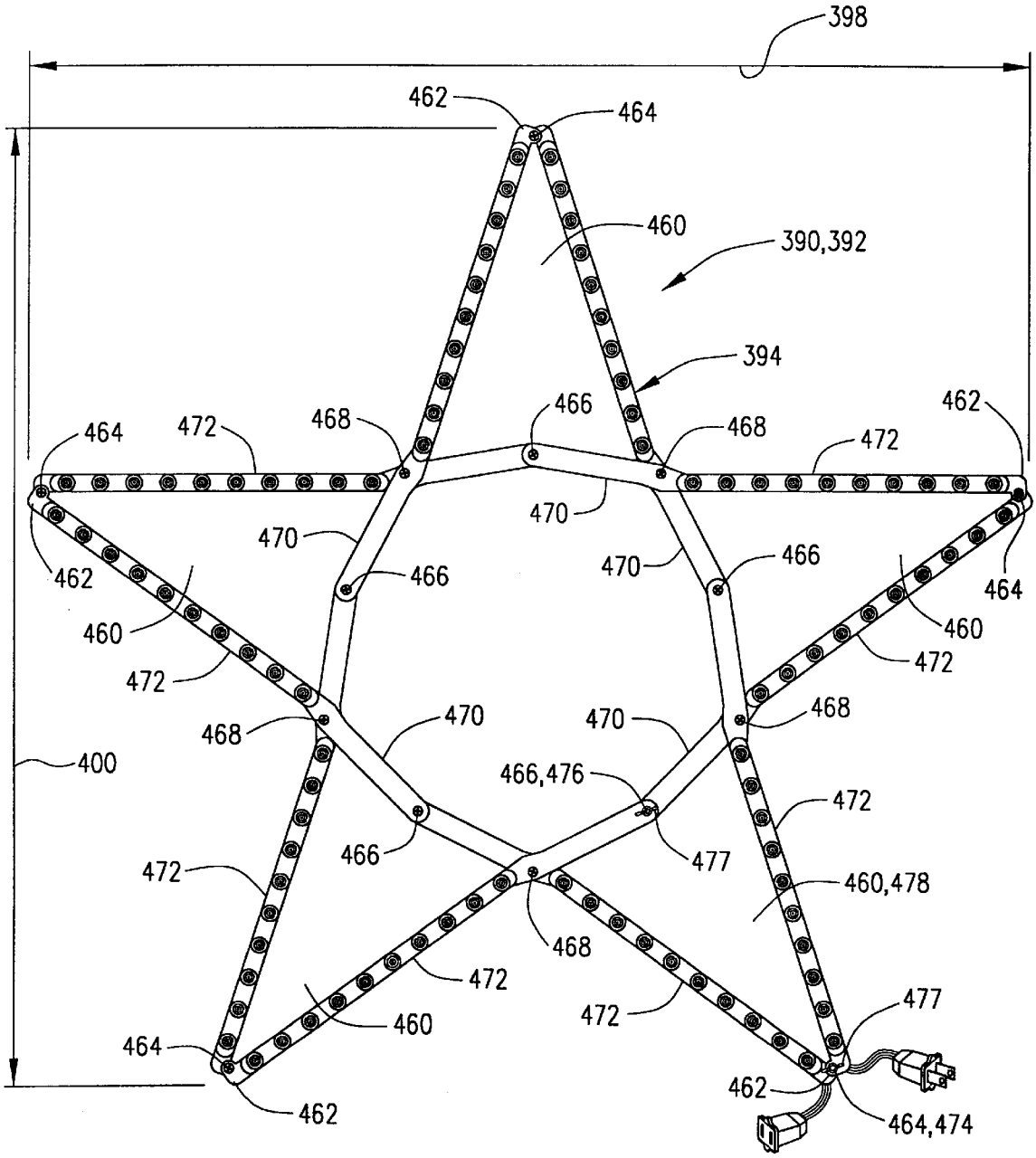
FIG. 17 shows an alternative embodiment of the reconfigurable star apparatus of the present invention in a display position.

An additional embodiment of the apparatus of the present invention is shown in FIG. 17 and is generally designated by the numeral 390. Reconfigurable star apparatus 390 has a display position 392 in which the apparatus defines a star 394 and has a collapsed position 396. Apparatus 390 has a display length 398 and a display width 400. Apparatus 390 likewise has a storage or collapsed length 402 and a storage or collapsed width 404 such that the outer boundaries of the apparatus in its storage position define a generally rectangular shape in storage position 394. Storage length 402 is less than length 398 and storage width 404 is less than display width 400 and is also less than storage length 402.

Apparatus 390 is comprised of a plurality of elements 406 which in the embodiment shown comprises five identical left-hand members 408 and five identical right-hand members 410. Left-hand members 408 have a first end 412 and a second end 414 and a length 415. Members 408 have a light mounting or first portion 416, a transition portion 418 and a base or second portion 420. Element 408 defines a first end opening 422 at the first end thereof, a second end opening 424 at the second end thereof and an intermediate opening 424 positioned in transition portion 418. Base portion 420 is angled from mounting portion 416. Openings 422, 424 and 426 are adapted to receive connecting screws, connecting pins or other connecting means. Mounting portion 416 is generally U-shaped having sides 428 connected to an upper panel 430. A plurality of mounting bosses 432 extend upwardly from upper panel 430 and are adapted to receive and hold lights 100. Connecting wires 104 may be positioned beneath panel 430.

Right-hand elements 410 are the mirror image of left-hand elements 408 and thus include a first end 434 and a second end 436 and have a length 437 identical to length 415. Element 410 includes a mounting portion 438, a transition portion 440 and a base portion 442. Element 410 defines a first end hole 444, a second end hole 446 and an intermediate hole 448 positioned in transition portion 440.

Mounting portion 438 is generally U-shaped and comprises legs 450 and an upper panel 452. A plurality of mounting bosses 454 extend upwardly from mounting panel 452 and are adapted to receive lights 100. Mounting portion 438 is adapted to conceal connecting wires 104 which may be placed beneath mounting panel 452.

Referring now back to FIG. 17, apparatus 390 comprises a star having a plurality of projections and in the embodiment shown having five projections 460 which define star points 462. Members 408 and 410 are arranged such that each projection in the star is defined by one element 408 and one member 410. Each member 408 may be connected at its first end 412 to the first end 434 of a member 410 by utilizing a screw extending through first end holes 422 and 444 along with a nut or any other fastener arrangement known in the art which will allow pivotal movement. The second end of each element 408 is adapted to be connected to the second end of an element 410 through end holes 424 and 446, respectively, utilizing a screw and nut or any other fastener arrangement known in the art to allow pivotal movement. Each element 408 intersects an adjacent element 410 of an adjacent projection. Intersecting elements 408 and 410 may be connected utilizing a screw and nut or other fasteners known in the art which will extend through intermediate openings 426 and 448.

Connections between the first ends of elements 408 and 410 may be referred to as first end connections 464. Connections between the second ends of elements 408 and 410 may be referred to as second end connections 466. Connections between elements 408 and 410 at the intermediate transition openings may be referred to as intermediate or base point connections 468.

Second portions 420 and 442 of elements 408 and 410 define bases 470 of projections 460. Portions 416 and 438 of legs 408 and 410 define sides 472 of projections 460. At least one first end connection 464 and second end connection 466 are releasable connections 474 and 476, respectively.

In the embodiment shown, releasable connections 474 and 476 utilize a wing nut 477 along with a screw or other threaded fastener. Thus, there is at least one separable projection 478 in which sides 472 defined by elements 408 and 410 along with the base portion 470 may be separated by releasing connections 474 and 476. Once the connections are released, apparatus 390 may be easily moved to its collapsed position by rotating the legs 408 and 410 of the separable projection 478. Each of the members are pivotably connected at at least the remainder of the first end, second end and intermediate connections 464, 466 and 468 so that each member may be pivoted relative to the members to which it is connected until the apparatus is moved to its collapsed or storage position 396.

An apparatus 390 having a display length and width of several feet can therefore be packaged in a relatively compact box for shipping and/or storage by pivoting the members about its connections points to place it in its storage position. Length 402 is, in the embodiment shown in FIGS. 17–23, equal to the maximum length of a member used to construct the apparatus, and is thus equal to length 415. Length 415 of apparatus 390 in its storage position 396 is therefore equal to one-half the length of the apparatus in display position 392.

Although the invention has been described herein with reference to specific embodiments and with respect to specific usages, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as follows in the scope of the invention.

What is claimed is:

1. A reconfigurable star apparatus comprising:

a plurality of members pivotably connected to one another at a plurality of pivotable connections and movable from a display position to a collapsed position, wherein in said display position said members are arranged to define a star having a plurality of projections, the sides of the projections being defined by adjacent ones of said members, at least one of said projections being a separable projection wherein said members that define said separable projection may be separated and the plurality of members pivoted about said pivotable connections to move said apparatus from its display position to its collapsed position wherein said apparatus has a collapsed length and collapsed width in said collapsed position, said collapsed length and width being less than a display length and width of said apparatus in its display position; and a light attachment track connected to each member, and a plurality of lights attached to said light attachment track.

2. The apparatus of claim 1 wherein each projection defines a star point, said members being connected to one another at said star points, and wherein the members that define said separable projection are releasably connected so that said members defining said separable projection may be separated and the members comprising said apparatus may be pivoted about the other of said connections at said star points to move said apparatus between its display and collapsed positions.

3. The apparatus of claim 2, wherein said members are pivotably connected to an adjacent member of an adjacent projection.

4. The apparatus of claim 1 wherein the sides of said projections are defined by a first portion of each member, and wherein a second portion of each member defines at least a portion of a base of one of said projections.

5. The apparatus of claim 4, wherein in said display position the first end of each of said members is positioned adjacent the first end of an adjacent member, the first end being defined on the first portion of the member, and the second end of each of said members is positioned adjacent the second end of another of said members, the second end being defined on the second portion of the member, the first ends of the members that define said sides of said separable projection being separable from one another, and the second ends of the members that define the base of said separable projection being separable from one another, the members being pivotable about the unseparated first and second ends to move between said display and said collapsed positions.

6. The apparatus of claim 5, wherein said members are pivotably connected to one another at at least the first and second ends that do not comprise the ends that are separable from one another.

7. The apparatus of claim 1, each of said members having a first end and a second end, the first ends of said members being connected to one another at first end connections and the second ends of said members being connected to one another at second end connections, the first end and second end connections of the members defining the separable projection being releasable.

8. The apparatus of claim 1, wherein in said collapsed position said apparatus has a collapsed length substantially equivalent to a length of one of said members, and wherein a collapsed width defined by said apparatus is less than its collapsed length.

9. The apparatus of claim 1 wherein said projections are substantially identically sized.

10. The apparatus of claim 1, wherein said apparatus is constructed of a plurality of substantially identical members.

11. The apparatus of claim 1, wherein an axis of said each of said lights is substantially parallel to an axis of the member to which said light is attached.

12. A reconfigurable star apparatus comprising:

a plurality of members pivotably connected to one another at a plurality of pivotable connections and movable from a display position to a collapsed position, wherein in said display position said members are arranged to define a star having a plurality of projections the sides of the projections being defined by adjacent ones of said members, at least one of said projections being a separable projection wherein said members that define said separable projection may be separated and the plurality of members pivoted about said pivotable connections to move said apparatus from its display position to its collapsed position wherein said apparatus has a collapsed length and collapsed width in said collapsed position, said collapsed length and width being less than a display length and width of said apparatus in its display position wherein the projections are not of equal length.

13. The apparatus of claim 12 wherein the sides of at least the longest of said projections are defined by a plurality of members connected to one another.

14. The apparatus of claim 13, said sides of said longest projection being comprised of two members connected to one another.

15. A reconfigurable decorative apparatus comprising:

a plurality of members each having first and second ends, the first end of each of said members being connectable to the first end of an adjacent one of said members to define a plurality of first end connections, said apparatus being movable between a display position and a collapsed position, wherein in said display position said members are arranged to define a star having a plurality of projections, at least one of said first end connections being a releasable connection, and wherein said members pivot about said first end connections so that said apparatus may be moved between said display and said collapsed positions when said releasable connection is released; and a light attachment track connected to each member and a plurality of lights attached to said light attachment track.

16. The apparatus of claim 15, each of said projections defining a star point in said display position, said first ends being connected at said star points.

17. The apparatus of claim 15, wherein the second end of each of said members is connectable to the second end of another of said members to define a plurality of second end connections, at least one of said second end connections being a releasable connection, and wherein said members pivot about the unreleased first and said second end connections so that said apparatus may be moved between said display and said collapsed positions when said releasable first end and second end connections are released.

18. The apparatus of claim 15, wherein adjacent members connected at their first ends define the sides of a projection, and wherein each member intersects an adjacent member of an adjacent projection and is pivotally connected thereto.

19. The apparatus of claim 15, wherein a length of said apparatus in said collapsed position is equal to or less than a length of the longest of said members.

20. The apparatus of claim 19, wherein a width of said apparatus in said collapsed position is less than said length in said collapsed position.

21. The apparatus of claim 15, wherein said apparatus defines five projections in said display position.

22. The apparatus of claim 21, wherein said apparatus comprises ten substantially identical members.

23. The apparatus of claim 15, wherein said star defines six projections in said display position.

24. The apparatus of claim 23, wherein said apparatus includes twelve substantially identical members.

25. A decorative star apparatus comprising:

a plurality of substantially identical members arranged to define a star having a plurality of projections, each of said members having first and second ends and being connected to one another at the first ends thereof to define first end connections, at least one of the first end connections being a releasable connection, wherein said releasable connection may be released and the members pivoted about the remainder of said connections to allow said apparatus to move from its display to a collapsed position;

a mounting track connected to each of said members; and a plurality of lights attached to said mounting track.

26. The apparatus of claim 25, wherein said star is comprised of ten identical members.

27. The apparatus of claim 25, wherein said star is comprised of twelve identical members.

28. The apparatus of claim 25, wherein each said member is pivotably connected to an adjacent member of an adjacent projection.

29. The apparatus of claim 25, wherein said members are tubular members.

30. The apparatus of claim 25, wherein a length of said apparatus in said collapsed position is not greater than a length of one of said members.

31. The apparatus of claim 25, said second end of each of said members being connected to the second end of another of said members to define second end connections, at least one second end connection being a releasable connection, wherein said releasable second end connection may be released and said members pivoted about the remainder of said second end connections to allow said apparatus to move between its display and collapsed positions.

* * * * *